US005951183A

United States Patent [19]

Landis

[11] Patent Number: 5,951,183

[45] Date of Patent: Sep. 14, 1999

[54] SHIELDED WRITING APPARATUS

[75] Inventor: Timothy J. Landis, Loomis, Calif.

[73] Assignee: OP-D-OP, Inc., Roseville, Calif.

[21] Appl. No.: 09/115,420

[22] Filed: Jul. 14, 1998

[51] Int. Cl.[6] ..... A46B 11/00

[52] U.S. Cl. ..... 401/48; 401/6; 401/88; 401/131

[58] Field of Search ..... 401/6, 48, 88, 401/131; 211/69.5; 248/118.5; 434/162, 166, 260, 261; 15/437; 33/18.1, 18.2; 623/65; 423/1; D19/84

[56] References Cited

FOREIGN PATENT DOCUMENTS

WO 96/39309 12/1996 WIPO .

*Primary Examiner*—Henry J. Recla

*Assistant Examiner*—Huyen Le

*Attorney, Agent, or Firm*—John P. O'Banion

[57] ABSTRACT

A shielded writing apparatus for preventing cross-contamination between a writer's hand and the writing surface and a writing instrument. The apparatus comprises a plate, a finger handle protruding outwardly from the upper surface of the plate and a sheath attached by a flexible cord to the finger handle, such that the sheath is maintained by the cord in a substantially vertical position. The sheath is adapted to receive a writing instrument and maintains the writing instrument in a generally vertical position when not in use. The finger handle is grasped by the last finger and the adjacent finger/s of the writing hand, while the thumb and forefinger holds the sheath containing the writing instrument, in a customary writing fashion. As the writer writes with the writing instrument, the apparatus moves along the writing surface along with the hand such that the plate forms a barrier between the butt of the hand and the writing surface.

19 Claims, 3 Drawing Sheets

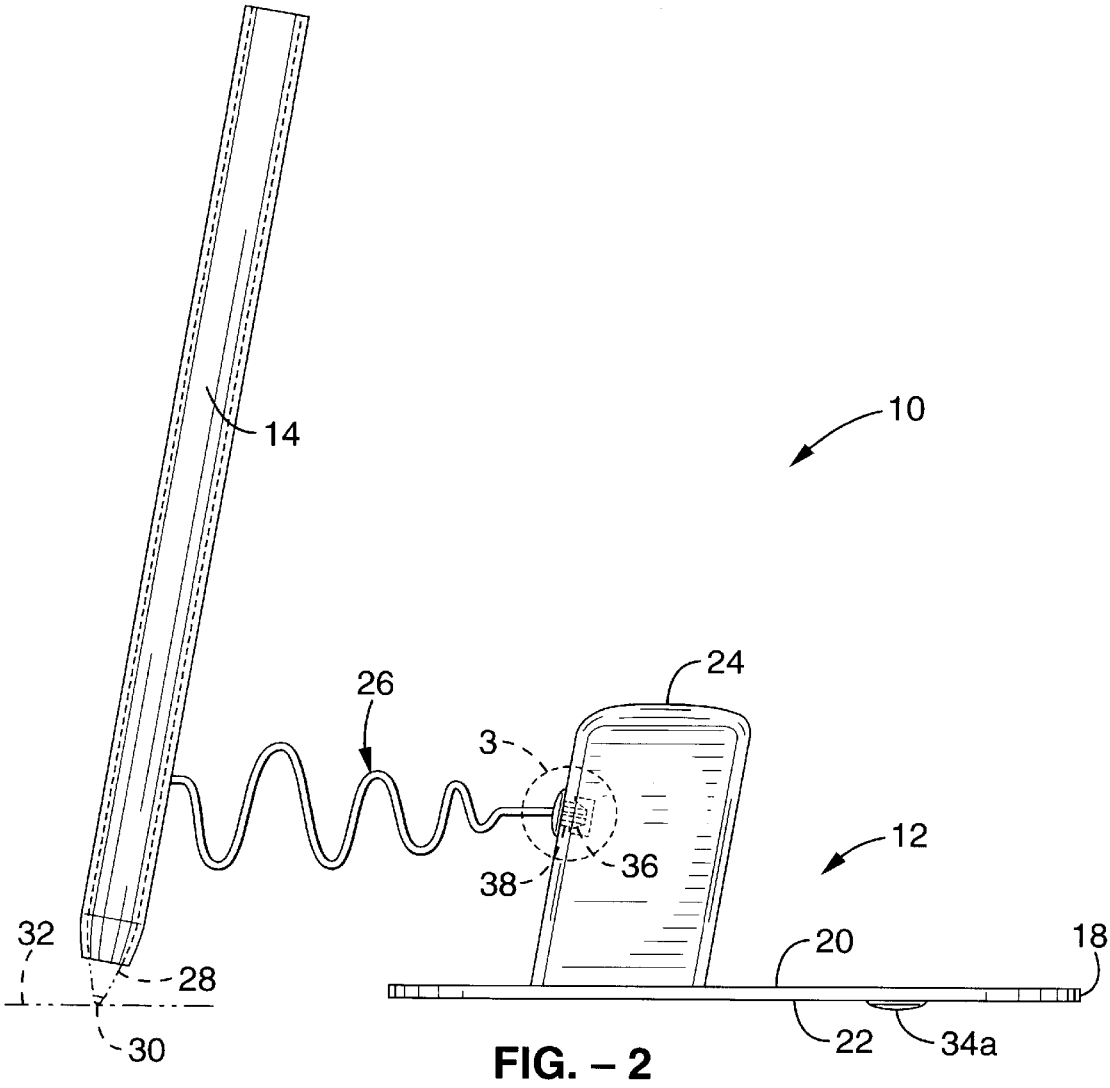
FIG. – 2
FIG. – 3
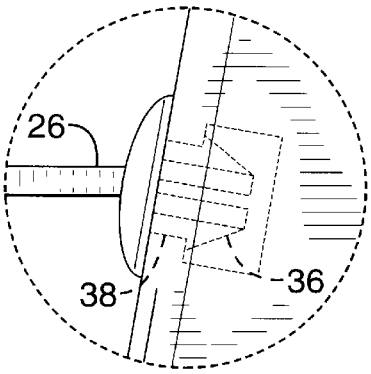

SHIELDED WRITING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to writing instrument accessories and more particularly to an instrument for shielding the writer's hand from both the writing instrument and the writing surface.

2. Description of the Background Art

In the health care environment, it is often critical to maintain aseptic conditions. Health care and dental care workers alike, typically gloved, frequently need to take notes or make data entries on paper or the like during patient treatment and must avoid picking up contamination on their gloves, from either the writing surface or the writing instrument, which could ultimately be transferred to the patient. Conversely, they must also avoid transferring to the writing surface any contamination on their hands or gloves, which could also lead to the spreading of infection. Aseptic pens are available, which can be autoclaved to preserve sterility. However, such pens are expensive and require frequent sterilization. Moreover, cross-contamination with the writing surface could still occur through direct contact between the writing hand and the writing surface.

Although having different objectives, a similar need is present in the industrial working environment. For example, a mechanic having grease-soiled hands may need to make notes without soiling the paper and the writing instrument.

To avoid picking up ink or other writing fluid on the hand, protective cuffs have been employed. This cuff is secured to the wrist or hand and cover the butt of the hand that comes into contact with the writing surface. Among other limitations, cuffs are clumsy and inconvenient, particularly as they are time consuming to put on and remove for each use.

In an attempt to avoid cross-contamination, shield plates have been employed that are adapted to rest on the writing surface below the butt of the hand and to slide across the writing surface below the butt of the hand as it writes. The underside of the shield is provided with several short spaced-apart projections serving as support legs to lift the plate above the writing surface. The support legs lower the frictional contact area with the writing surface so that the hand contact on the upper side of the plate is sufficient to cause the plate to slide over the writing surface, along with the hand as it writes. Because the device must be elevated, it consequently also elevates the hand to an unnatural writing position, and because it is mounted on legs, the shield plate must be capable of resisting bending forces during the hand's writing motion. Consequently, the plate is relatively thick, heavy and unwieldable. To move the device from one writing surface to another, the user must pick it up and hold it at the side edges, which can likely bring the fingers into contact with the writing surface, causing cross-contamination. Additionally, due to the low and flat configuration of the device, it is not conducive to be adapted for supporting a writing instrument when the writing instrument is not in use.

A modification of the shield plate concept has been developed where a thin plate having a finger handle protruding upward from the plate is used as a writing shield. To use this device, the little finger and its adjacent finger grasps the handle, while simultaneously, the thumb and forefinger grasps a writing instrument in the customary manner. In this position, the plate is horizontally disposed beneath the butt of the hand and above the writing surface, however the tip of the writing instrument has contact with the writing surface. As the hand writes, the device slides along the writing surface to shield the hand from the surface. The finger handle contains a cavity adapted for storage of the writing instrument when not in use. A tubular shield is also provided into which a writing instrument can be inserted to further protect the user from cross-contamination. The problem encountered with this device is that proper use requires excessive time and attention from the writer who has to carefully pick up the writing instrument and then carefully set it down when finished. The cavity within the finger handle fails to consistently contain the writing instrument, especially when the writing instrument is hurriedly inserted therein. In the case of a dentist for example, the dentist, while in the process of treating a patient, must rapidly grab the writing shield and instrument, write the necessary notes with the instrument, then release the shield and writing instrument to direct his attention back to the patient. Especially true during critical treatment procedures, the dentist cannot spare the extra time and attention required to lay the shield down, look for the cavity in the finger holder and carefully set the writing instrument therein.

Accordingly, there is a need for a shielded writing apparatus which provides a hand shield that is light, wieldable and easy to use without compromising the normal writing posture, which may be transparent, which may be easily lifted from one surface and placed onto another without the risk of cross-contamination, which is inexpensive to manufacture and which provides a means for automatically retaining a writing instrument thereto when not in use. The present invention satisfies these needs, as well as others, and generally overcomes the deficiencies present in the background art.

BRIEF SUMMARY OF THE INVENTION

The present invention is a shielded writing apparatus for preventing cross-contamination between a writer's hand and the writing surface and between the writer's hand and a writing instrument. The apparatus comprises a plate having an upper and a lower surface, a finger handle attached to the upper surface of the plate and protruding outwardly therefrom, and a sheath attached by a flexible cord to the finger handle, such that the sheath is maintained by the cord in a substantially vertical position relative to the plate. The sheath is adapted to receive a writing instrument therein, such as a pen, and maintain the writing instrument in a generally vertical position ready for immediate use.

To use the apparatus, the writer grasps the finger handle with the last finger and the adjacent finger of the writing hand and simultaneously holds the sheath containing the writing instrument with the thumb and forefinger, in a customary writing fashion, and begins writing on a writing surface. As the writing hand moves across the writing surface the apparatus moves along with the hand such that the plate forms a barrier between the butt of the hand and the writing surface. When completed, all the writer need do is to release the sheath and the finger handle, and the apparatus will remain standing by itself, poised ready for its next use.

An object of the invention is to provide a hand shield writing apparatus that is light, wieldable and easy to use without compromising the normal writing posture.

Another object of the invention is to is to provide a hand shield writing apparatus which may be transparent.

Another object of the invention is to is to provide a hand shield writing apparatus may be easily lifted from one surface and placed onto another without the risk of cross-contamination.

Another object of the invention is to is to provide a hand shield writing apparatus which is inexpensive to manufacture.

Still another object of the invention is to is to provide a hand shield writing apparatus which provides a means for automatically retaining a writing instrument thereto when not in use.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 2 is a side elevational view of the shielded writing apparatus shown in FIG. 1.

FIG. 3 a detailed view of a collapsible clip shown in FIG. 2.

DETAILED DESCRIPTION OF THE INVENTION

Referring more specifically to the drawings, for illustrative purposes the present invention is embodied in the apparatus 10 generally shown in FIG. 1 through FIG. 4. It will be appreciated that apparatus 10 may vary as to configuration and as to details of the parts without departing from the basic concepts as disclosed herein.

Figure 1:
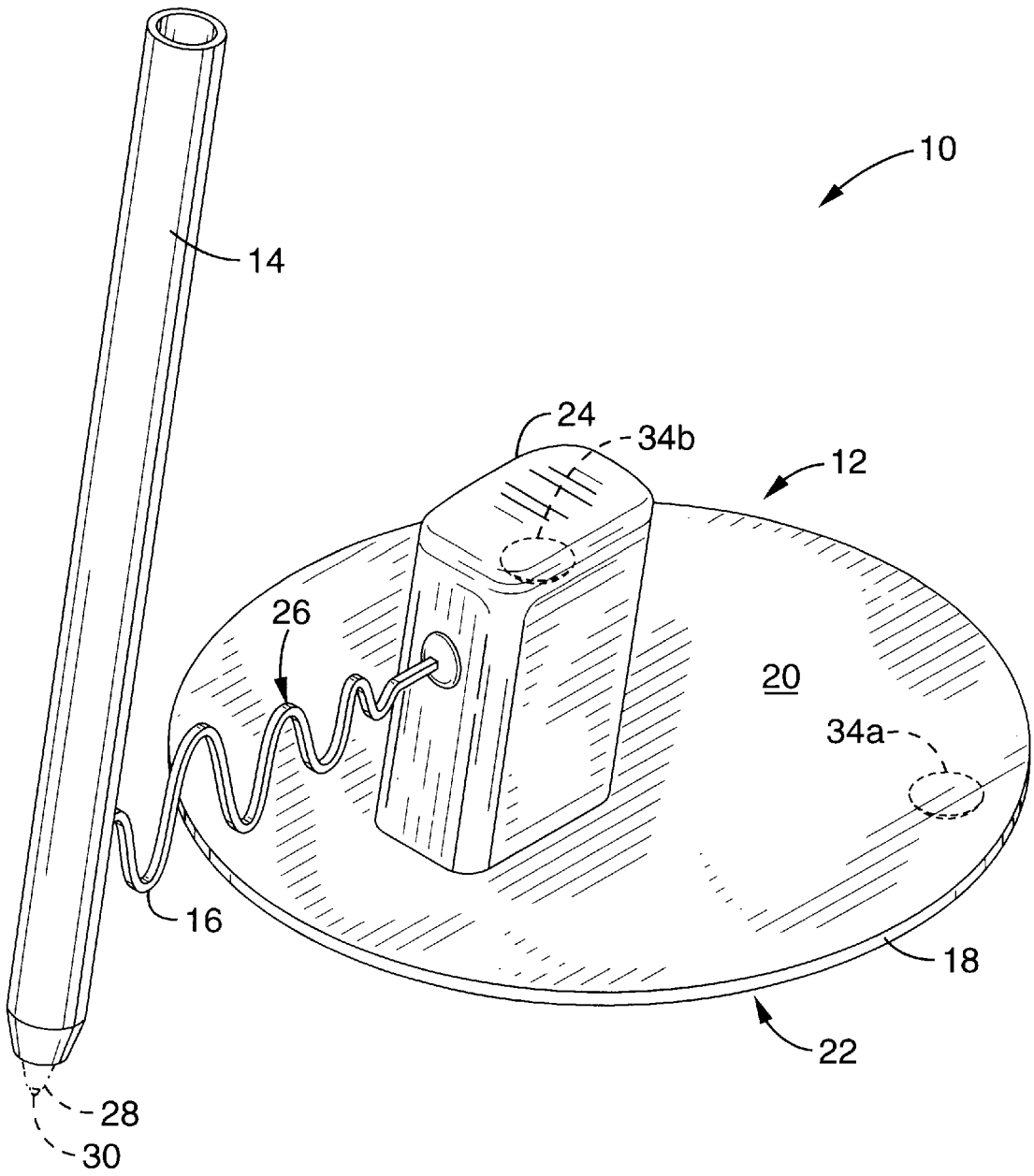
FIG. 1 is a perspective view of a shielded writing apparatus in accordance with the present invention.
Figure 4:
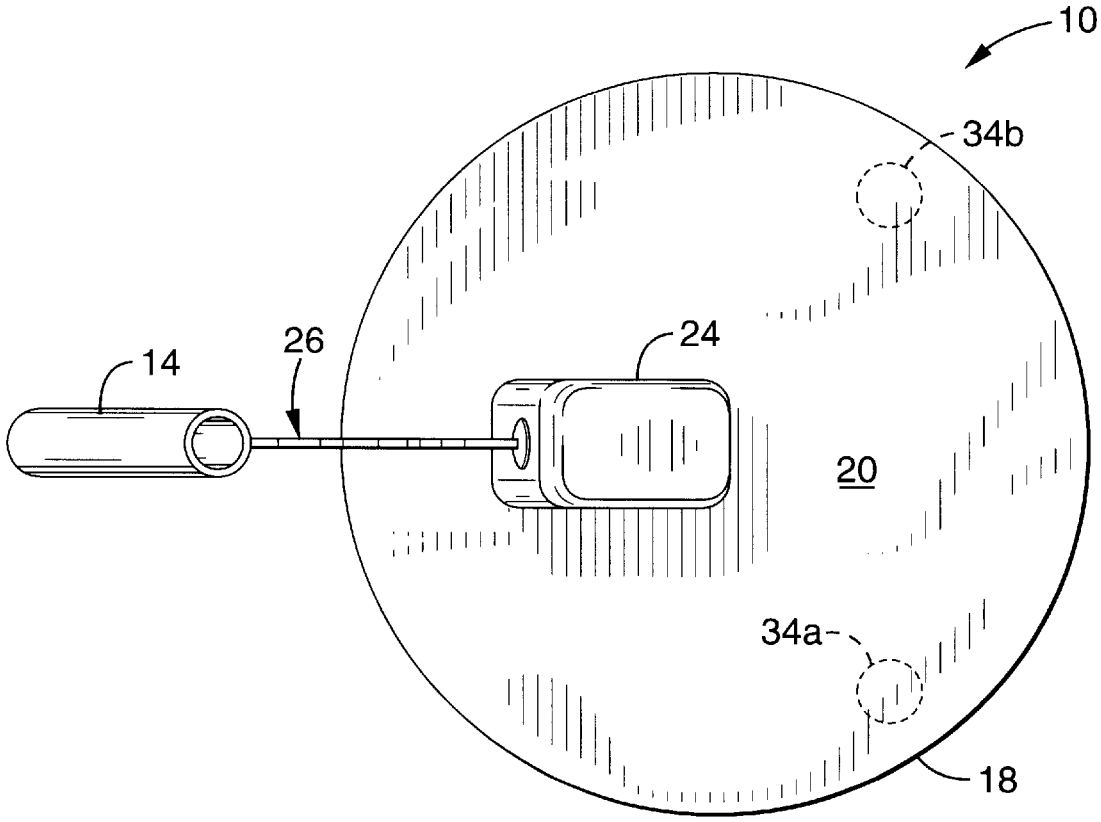
FIG. 4 is a top plan view of the shielded writing apparatus shown in FIG. 1.

Referring first to FIG. 1, FIG. 2 and FIG. 4, apparatus 10 generally comprises a base assembly 12, a sheath 14 and a coupling means 16 for coupling sheath 14 to base assembly 12. Base assembly 12 includes a substantially flat disk or plate 18 having a relatively smooth upper surface 20 and lower surface 22. A finger handle 24 is attached to upper surface 20 of plate 18 and protrudes outwardly therefrom. Sheath coupling means 16 is essentially a resilient cord 26 that not only keeps sheath 14 attached to base assembly 12, but also maintains sheath 14 in a relatively perpendicular position relative to plate 18. Sheath 14 preferably has a longitudinal shape with a circular cross-section and is specifically adapted to snugly receive a writing instrument 28, such as a pen or the like. When writing instrument 28 is inserted into sheath 14, coupling means 16 also maintains writing instrument 28 in a relatively vertical position with its tip 30 in proximity to writing surface 32, and preferably in contact with the writing surface 32 for stability. In such a position, writing instrument 28 is poised ready for immediate use.

In order for sheath coupling means 16 to accomplish the stated functions, resilient cord 26 must be flexible, yet firm enough to maintain writing instrument 28 relatively vertical while writing instrument 28 is standing on its tip 30 in contact with writing surface 32 or any other surface that apparatus 10 may be set on. Cord 26 is typically fabricated from polypropylene and is squiggle-shaped, thus giving cord 26 flexibility and resiliency. It is also contemplated that other cord configurations, such as a helically-wound cord (not shown), would accomplish a similar function. Cord 26 is preferably integral to sheath 14 and removably coupled to finger handle 24 by a collapsible clip 36 inserted into an aperture 38 in finger handle 24, as can be seen in FIG. 3. Alternatively, cord 26 could also be attached to plate 18 instead of finger handle 24. Sheath 14 is preferably fabricated from a pliable material, such as a rubber compound or a plastic, which would allow sheath 14 to conform to the shape of writing instrument 28 inserted therein. The diameter of sheath 14 should be slightly less than writing instrument 28 and expandable so that it expands to snugly hold writing instrument 28 when inserted.

A pair of legs 34 are located on lower surface 22 of plate 18. Legs 34 are spaced equidistant from each other such that tip 30 and legs 34 form the apices of an equilateral triangle. This balances and stabilizes apparatus 10 when it is set down on writing surface 32.

In using apparatus 10, finger handle 24 is grasped using the writing hand by the little finger and adjacent finger, and placed within the palm of the hand, while the thumb and forefinger grasps sheath 14 containing writing instrument 28 in a typical writing fashion. Since tip 30 is already touching writing surface 32, the writer can immediately begin taking notes, making sketches or the like on writing surface 32. As the writing hand moves across writing surface 32, base assembly 12 moves correspondingly along with the hand, and plate 18 forms a barrier between the butt of the hand and writing surface 32, thereby preventing contact any therebetween. Similarly, since sheath 14 provides an envelope for writing instrument 28, cross-contamination between writing instrument 28, the thumb and the forefinger is prevented. Since plate 18 is substantially transparent, the writer can see through plate 18 onto writing surface 32. The flexibility and resiliency of cord 26 allows sheath 14 to be moved about as notes, sketches or the like are being made with writing instrument 28.

To facilitate writer comfort and ease of use, finger handle 24 may be flexibly mounted onto plate 18, thus allowing finger handle 24 to conform to the inner palm of the hand and to move as required as the hand moves across writing surface 32. Finger handle 24 may have a round, oval or rectangular cross-section and may also be contoured for ease of gripping by the little finger and its adjacent finger. Finger handle 24 can also be offset at a slight angle to better conform to the palm when the hand is in a typical writing position.

Plate 18 preferably has sufficient surface area to fully underlie the butt of the hand while held in a typical writing position, so that it will provide a full barrier between hand and writing surface 32 to prevent cross-contamination therebetween. Plate 18 also preferably terminates somewhat short of tip 30 of writing instrument 28 when writing instrument 28 is inserted into sheath 14 so that tip 30 can not only contact writing surface 32, but also has some surface area to move around when being used for normal writing, unimpeded by plate 18. The relative smoothness of lower surface 22 of plate 18 allow plate 18 to easily slide over writing surface 32 as the hand moves.

Accordingly, it will be seen that this invention is an inexpensive, easy to use writing shield apparatus that prevents cross-contamination between a writer's hands and fingers and between the writing surface and writing instrument, yet requiring very little attention and care to use. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A shielded writing apparatus, comprising:

(a) a base assembly, said base assembly including a plate having an upper surface and a lower surface, said base assembly including a finger handle protruding from said upper surface of said plate, said handle adapted to be grasped by a plurality of fingers on a writer's hand beginning with a little finger and adjacent fingers;

(b) a sheath configured to receive a writing instrument therein; and (c) means for flexibly coupling said sheath to said base assembly, wherein said sheath maintains said writing instrument in a substantially vertical position and in contact with a writing surface when said writing instrument is inserted within said sheath.

2. An apparatus as recited in claim 1, wherein said sheath is positioned proximate to said finger handle such that when said fingers grasp said finger handle, said thumb and forefinger can grasp said sheath.

3. An apparatus as recited in claim 1, further comprising a plurality of legs on said lower surface of said plate, said legs disposed in an equally spaced-apart configuration thereby providing balance and stability to said base assembly.

4. An apparatus as recited in claim 3, wherein one of said plurality of legs comprises a writing end of said writing instrument when said writing instrument is inserted within said sheath.

5. An apparatus as recited in claim 1, wherein said coupling means comprises a resilient cord attached between said finger handle and said sheath.

6. An apparatus as recited in claim 5, wherein said cord is detachable from said finger handle.

7. An apparatus as recited in claim 1, wherein said plate is substantially transparent.

8. A shielded writing apparatus, comprising:

(a) a base assembly, said base assembly including a plate having an upper surface and a lower surface, said base assembly including a finger handle protruding from said upper surface of said plate, said handle adapted to be grasped by a plurality of fingers on a writer's hand beginning with a little finger and adjacent finger;

(b) a sheath configured to receive a writing instrument therein, said sheath positioned proximate to said finger handle such that when said little finger and adjacent finger grasps said finger handle, said thumb and forefinger can grasp said sheath; and (c) means for flexibly coupling said sheath to said base assembly, wherein said sheath maintains said writing instrument in a substantially vertical position and in contact with a writing surface when said writing instrument is inserted within said sheath.

9. An apparatus as recited in claim 8, further comprising a plurality of legs on said lower surface of said plate, said legs disposed in an equally spaced-apart configuration thereby providing balance and stability to said base assembly.

10. An apparatus as recited in claim 9, wherein one of said plurality of legs comprises a writing end of said writing instrument when said writing instrument is inserted within said sheath.

11. An apparatus as recited in claim 8, wherein said coupling means comprises a resilient cord attached between said finger handle and said sheath.

12. An apparatus as recited in claim 11, wherein said cord is detachable from said finger handle.

13. An apparatus as recited in claim 8, wherein said plate is substantially transparent.

14. A shielded writing apparatus, comprising:

(a) a plate having an upper surface and a lower surface;

(b) a finger handle protruding from said upper surface of said plate, said handle adapted to be grasped by a plurality of fingers on a writer's hand beginning with a little finger and adjacent finger; and (c) a sheath flexibly coupled to said finger handle, said sheath configured to receive a writing instrument therein, said sheath positioned proximate to said finger handle such that when said little finger and adjacent finger grasps said finger handle, said thumb and forefinger can grasp said sheath;

(d) wherein said flexible coupling is capable of maintaining said sheath in a relatively perpendicular position relative to said plate.

15. An apparatus as recited in claim 14, further comprising a plurality of legs on said lower surface of said plate, said legs disposed in an equally spaced-apart configuration thereby providing balance and stability to said plate.

16. An apparatus as recited in claim 15, wherein one of said plurality of legs comprises a writing end of said writing instrument when said writing instrument is inserted within said sheath.

17. An apparatus as recited in claim 14, wherein said flexible coupling comprises a resilient cord attached between said finger handle and said sheath.

18. An apparatus as recited in claim 14, wherein said cord is detachable from said finger handle.

19. An apparatus as recited in claim 14, wherein said plate is substantially transparent.

* * * * *